United States Patent [19]

Houghton et al.

[11] Patent Number: 4,522,188

[45] Date of Patent: Jun. 11, 1985

[54] GIMBAL-MOUNTED DRESSING DEVICE FOR GRINDING MACHINE

[76] Inventors: Royal E. Houghton, Box 113, Ascutney, Vt. 05030; Stanley J. Walasewicz, Box 84, Cavendish, Vt. 05142

[21] Appl. No.: 415,633

[22] Filed: Sep. 7, 1982

[51] Int. Cl.[3] ..... B24B 53/06

[52] U.S. Cl. ..... 125/11 CC; 125/11 B; 125/11 BS

[58] Field of Search ..... 125/11 R, 11 AS, 11 CC, 125/11 F, 11 BS, 11 B, 11 ST

[56] References Cited

U.S. PATENT DOCUMENTS 3,273,554 9/1966 Bunge ..... 125/11 R
3,411,492 11/1968 Merritt ..... 125/11 R
4,040,409 8/1977 Walasewicz ..... 125/11 AS
4,357,928 11/1982 Hopkins ..... 125/11 F

FOREIGN PATENT DOCUMENTS 509480 9/1930 Fed. Rep. of Germany .... 125/11 F

*Primary Examiner*—Harold D. Whitehead

[57] ABSTRACT

A two point diamond dresser is suspended from a gimbal mechanism for swinging about two orthogonal axes. A cam mechanism having one cam and two cam followers is provided to impart a swinging movement to the dresser about one pivot axis when the cam rotates in one direction so as to dress one angular surface of a nominally 90° included angle grinding wheel working face and then to impart a swinging movement to the dresser about the other pivot axis when cam rotation is reversed to dress the other surface of the grinding wheel working face.

9 Claims, 7 Drawing Figures

GIMBAL-MOUNTED DRESSING DEVICE FOR GRINDING MACHINE

FIELD OF THE INVENTION

The present invention generally relates to grinding machines and, in particular, to a grinding wheel dressing device.

BACKGROUND OF THE INVENTION

It is well known in the grinding machine art to dress the working face of the abrasive grinding wheel by several methods or forms. For example, a single point diamond, a multipoint diamond, rotary diamond or diamond roll have been used in the past. The type of grinding wheel working face and particular grinding operation to be performed prescribes the dressing device and method for providing an optimum working face. The dresser may be located on a pivoted swinging arm unit or may be a stationary unit with the grinding wheel traveling to the dresser.

A dressing device for imparting to the periphery of a grinding wheel either a combination radial and straight form, a radial form, a straight form, or a gothic arch form is disclosed in U.S. Pat. No. 4,040,409 issued Aug. 9, 1977. The patented dressing device employs a swingable turn post carrier, a turn post rotatably mounted on the turn post carrier and carrying a main dresser diamond, and cam means for swinging the turn post carrier through an arcuate path. U.S. Pat. No. 3,080,686 issued Mar. 12, 1963 is also relevant in this regard.

U.S. Pat. No. 2,292,947 issued Aug. 11, 1942 illustrates a wheel dressing device comprising several transverse and longitudinal slides to effect angular traversing movement of a pair of dresser diamonds past a grinding wheel working face having divergent angular surfaces.

Other grinding wheel dressing devices are shown in U.S. Pat. No. 2,689,434 issued Sept. 21, 1954; U.S. Pat. No. 2,947,302 issued Aug. 2, 1960; U.S. Pat. No. 3,102,529 issued Sept. 3, 1963; U.S. Pat. No. 3,167,064 issued Jan. 26, 1965; U.S. Pat. No. 3,438,156 issued Apr. 15, 1969; U.S. Pat. No. 3,481,319 issued Dec. 2, 1969 and U.S. Pat. No. 3,999,332 issued Dec. 28, 1976.

In the past, grinding wheels with a nominally 90° included angle (90° V-profile) working face have been used to simultaneously grind the outer diameter and adjacent flange face of bearings or similar type work parts. These 90° included angle grinding wheel working faces have been dressed by a twin diamond dresser mounted on a spring-loaded precision ball slide which moves to and from the grinding wheel on a path 90° to its axis. The ball slide, in turn, is mounted on a dovetail slide which, during dress, travels along a path parallel to the grinding wheel axis. This compound slide type arrangement enables one diamond to dress the angle on the front of the wheel and the other diamond to dress the angle on the back of the wheel. An adjustable, two-piece linear cam directly guides the diamonds and dictates the shape to be dressed. This dressing technique suffered from several disadvantages. In particular, this dressing technique could not produce a surface smoother than that of the cam due to the direct drive relations involved. The cam had to be ground smooth initially and from time to time reground after wear occurred. Non-straight wear in the cam and looseness in either slide were observed to result in unacceptable non-straightness in the dressed grinding wheel surface and therefore in the workpiece ground by the wheel.

SUMMARY OF THE INVENTION

The present invention provides an improved dressing device for dressing or truing a grinding wheel with an orthogonal working face, in particular a 90° V-profile working face. The dressing device in a typical working embodiment includes a gimbal mechanism from which a two-point dresser, such as a twin diamond dresser is suspended and swung about two orthogonal axes, and a cam mechanism mounted on the gimbal mechanism for actuating the gimbal mechanism to swing the dresser first about one axis and then about the other axis orthogonal thereto with the dresser traveling along a first path corresponding to one surface of the grinding wheel working face and then along a second path corresponding to the other surface of the working face.

In a preferred embodiment of the invention, the gimbal mechanism includes a stationary support member attached to the frame of the dressing device or to the grinding machine and having a pair of first trunnion seats, a dresser post carrier member having a pair of first trunnions pivotably mounted in the first trunnion seats and having a pair of second trunnion seats oriented orthogonally to the first trunnion seats, and a dresser post member having a pair of second trunnions pivotably mounted in the second trunnion seats and carrying a two-point diamond dresser. As a result of the orthogonal relationship between the first and second trunnions and the mounting of the dresser post member on the carrier member, the dresser can be pivotably swung along two orthogonal axes and be caused to travel in two paths which lie in the respective planes of the surfaces of the grinding wheel working face.

In another preferred embodiment, the gimbal mechanism has associated therewith certain adjustment means for insuring that the pivotable swinging motion imparted to the dresser deviates only negligibly from a straight line path.

In still another preferred embodiment, the cam mechanism includes a cam member, cam driving means and two cam followers. The cam member and cam driving means are mounted on the dresser post member and movable therewith. A first cam follower is mounted to the gimbal support member while a second cam follower is attached to the dresser post carrier member. The cam member preferably includes spaced-apart first and second lobed regions which are caused to successively engage against the respective first and second cam followers to pivotably swing the dresser post and diamond dresser thereon about one orthogonal axis and then the other.

DESCRIPTION OF PREFERRED EMBODIMENTS

Figure 1:
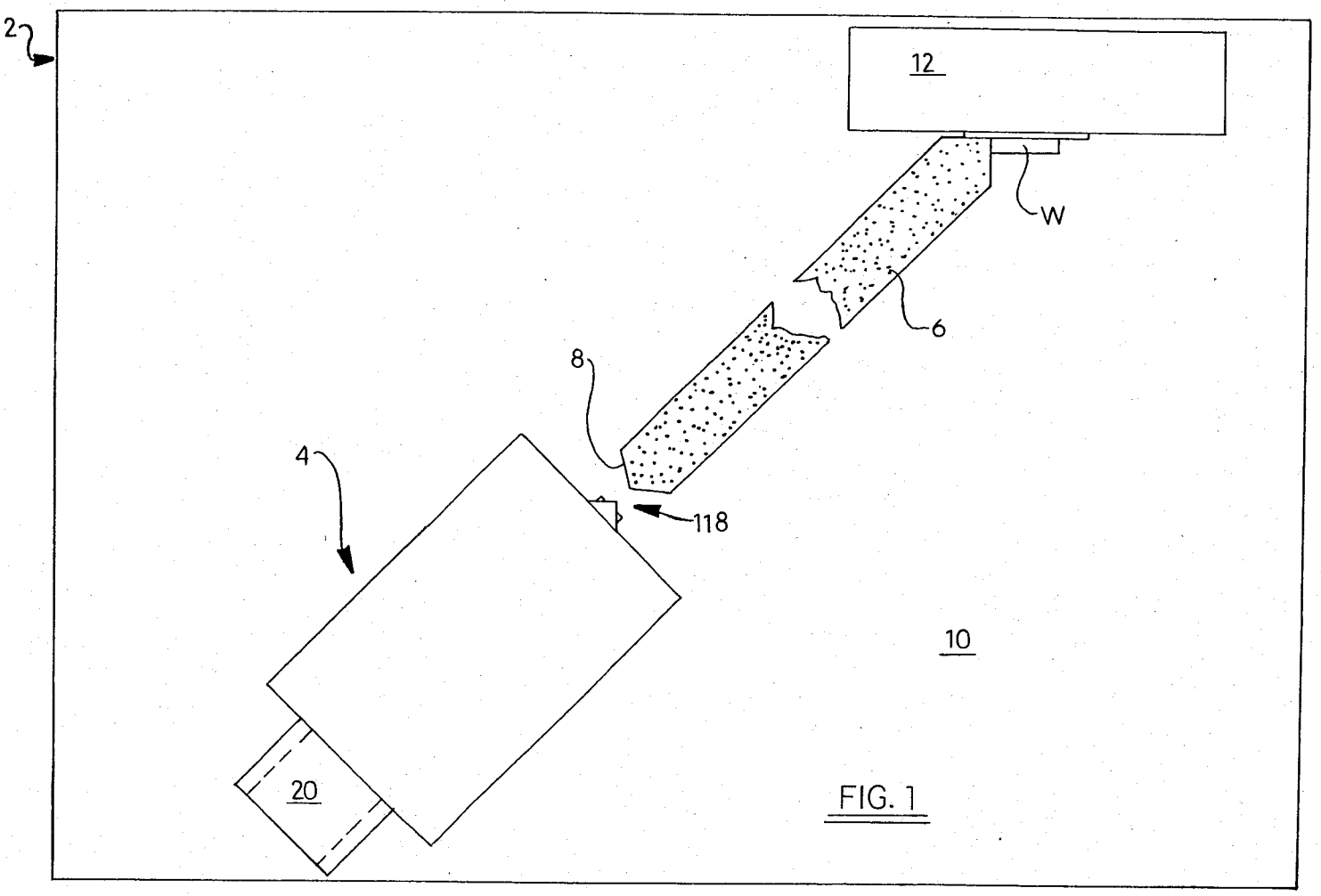
FIG. 1 is a schematic top elevation showing the main components of the grinding machine.

FIG. 1 illustrates a grinding machine 2 having a dressing device 4 constructed in accordance with the present invention for dressing or truing a grinding wheel 6 having a 90° V-profile working face 8. The grinding machine shown may be used for simultaneously grinding the outer diameter and adjacent flange of bearing raceway, W, or similar type workparts.

The grinding machine 2, in addition to the components already described, includes a conventional bed or base 10 on which is operatively mounted a conventional workhead 12. The workhead 12 is carried on a slide assembly (not shown) as is well known while the dressing device 4 is carried on slide 20 mounted on bed 10 in conventional fashion. The dressing device 4 is secured to slide 20 by a dovetail arrangement. Grinding machines representative of the type usable with the inventive dressing device 4 are models 1 M and 45 M Lectro-Cam® external centerless grinders manufactured by Bryant Grinder Corporation, Springfield, Vt. and also grinding machines described in the Healy U.S. Pat. No. 3,080,686 issued Mar. 12, 1963.

Figure 2:
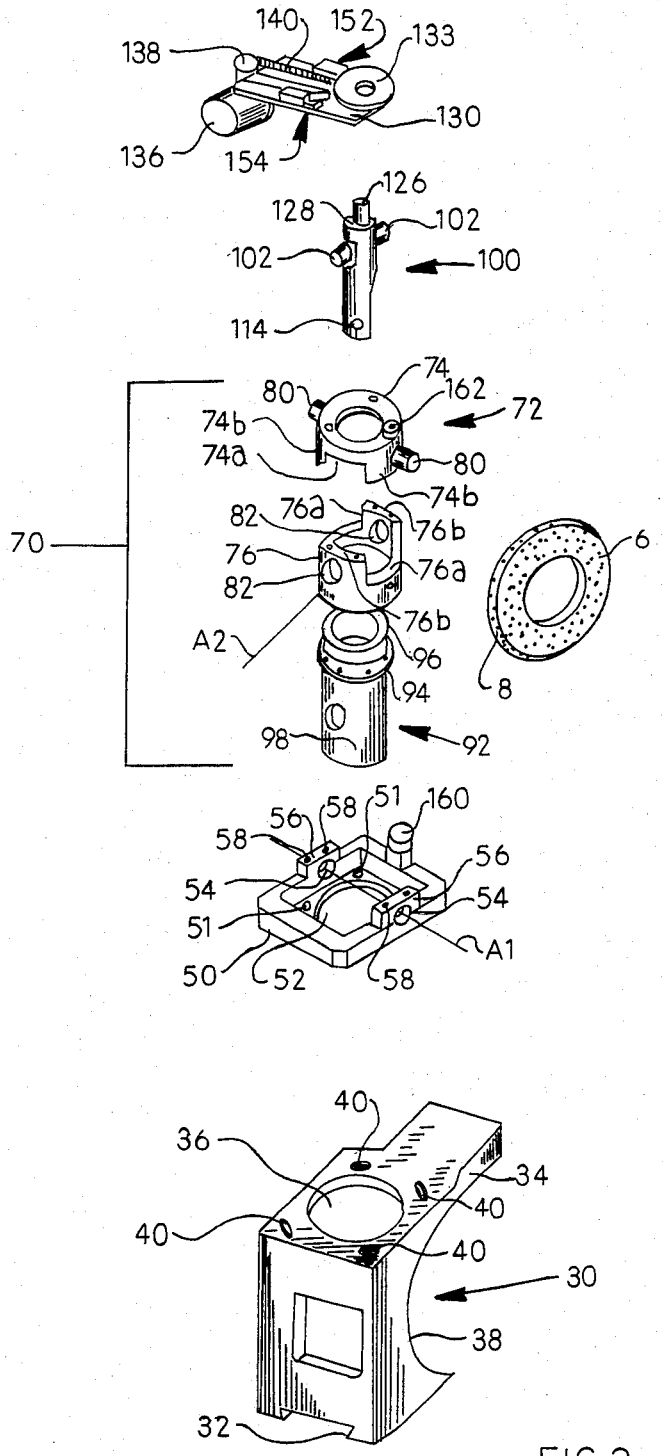
FIG. 2 is an exploded view of the dressing device with some components shown in somewhat schematic or simplified form.

FIG. 2 shows an exploded view of the dressing device. The dressing device includes a frame member 30 which is carried on slide 20 of the grinding machine. The frame member 30 includes a dovetail slot 32 for cooperating with slide 20, a frame arm 34, an aperture 36 through which portions of the gimbal mechanism to be described extend and an arcuate side access opening 38 to accommodate the disc-like grinding wheel 6. The frame arm 34 includes multiple threaded holes 40 through which mounting screws (not shown) extend for securing the gimbal mechanism thereon.

As shown in FIGS. 1–5, the gimbal mechanism comprises a gimbal support member 50 of tray shape having an aperture 52 through the bottom aligned with aperture 36 of frame arm 34 and having a pair of first trunnion seats 54. The trunnion seats 54 are provided between saddles 56 and support member 50, as shown most clearly in FIG. 3, and include bearing housing 60 screwed to saddles 56 and a tapered roller bearing assembly in the housing 60. The roller bearing assembly includes an outer race 62, inner race 64 and tapered rollers 66 therebetween. The saddles 56 are secured to the support member by screws 58. The gimbal support member 50 also includes slots 51 in the corners aligned with threaded holes 40 of the frame member 30 for purposes to be hereinafter described.

The gimbal mechanism also includes a dresser post carrier member 70 comprising a head 72 comprising an upper head portion 74 and lower head portion 76. The upper head portion includes a pair of recesses 74*a* adapted to receive upstanding sidewalls 76*b* of the lower head portion 76. Similarly, depending sidewalls 74*b* of upper head portion 74 are received in a pair of recesses 76*a* in the lower head portion. As shown most clearly in FIG. 5, a pair of adjustment screws 77 are threadably received in threaded holes extending through one of the upstanding sidewalls 76*b* and partially into the adjacent depending sidewall 74*b* of the upper head portion for purposes to be explained hereinbelow. The upper and lower head portions are fastened together by suitable machine screws with suitable adjustment spaces 79 therebetween.

Figure 3:
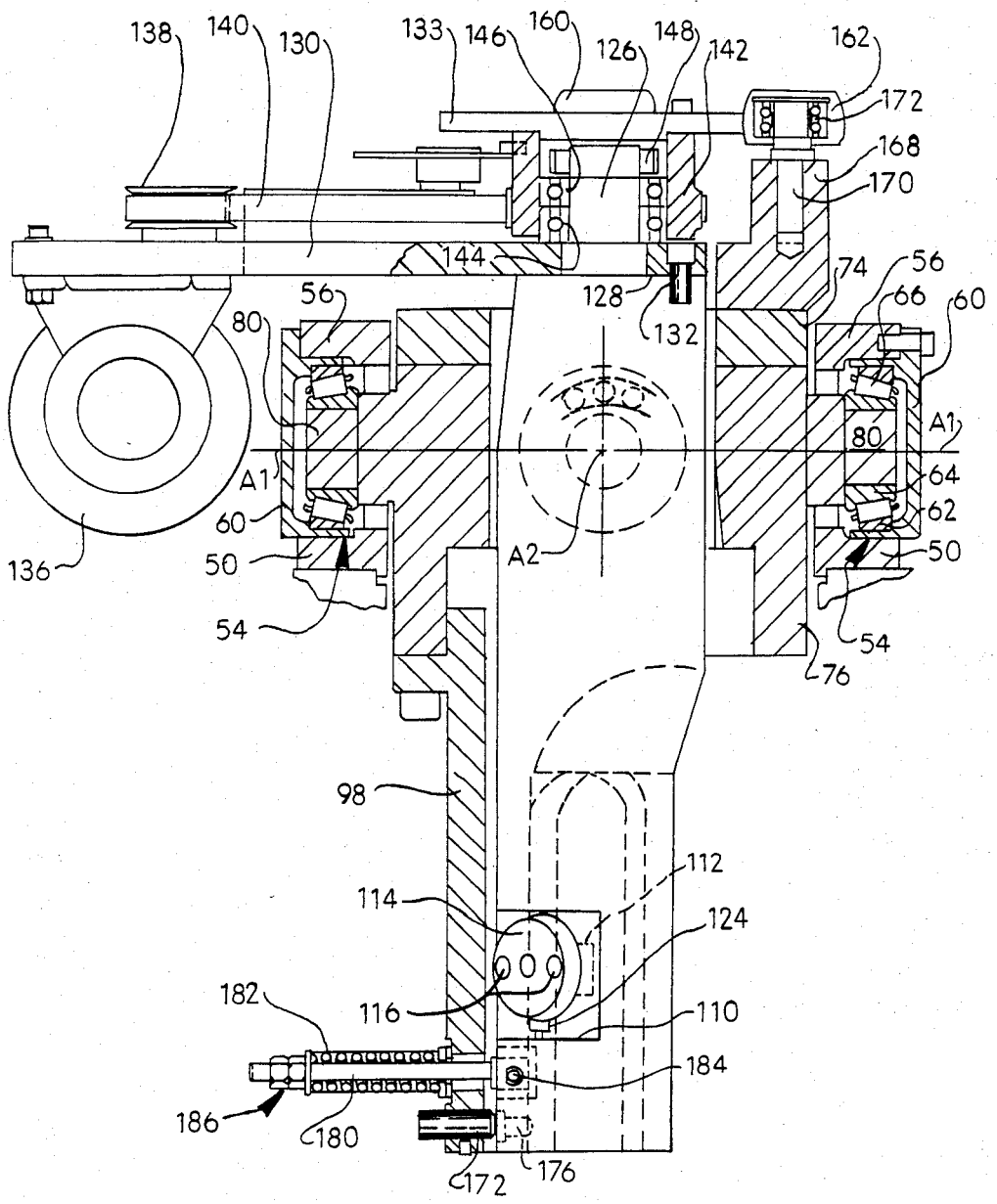
FIG. 3 is a sectional view of the dressing device taken along line 3—3 of FIG. 7.
Figure 4:
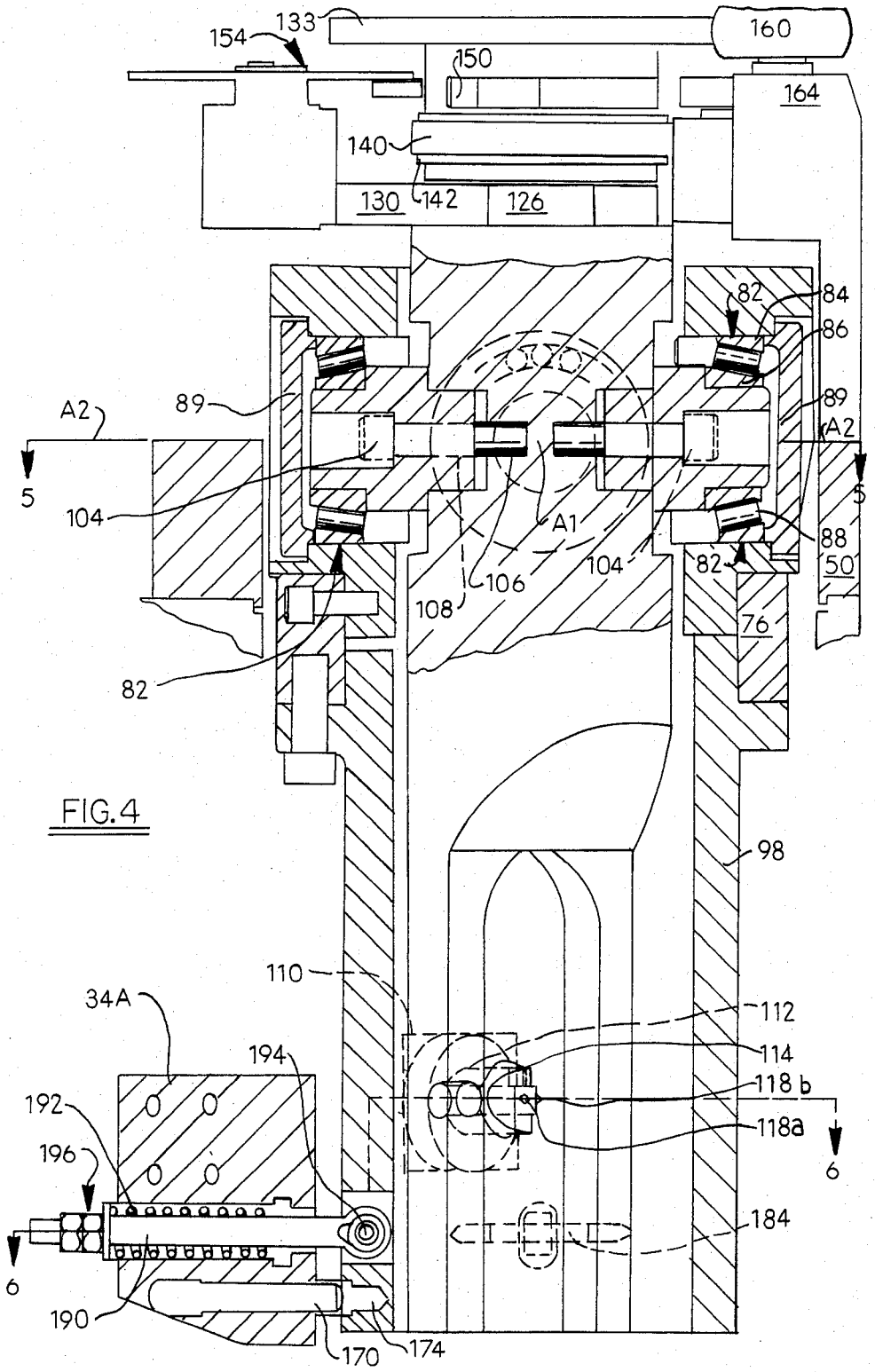
FIG. 4 is a sectional view of the dressing device taken along line 4—4 of FIG. 7.
Figure 5:
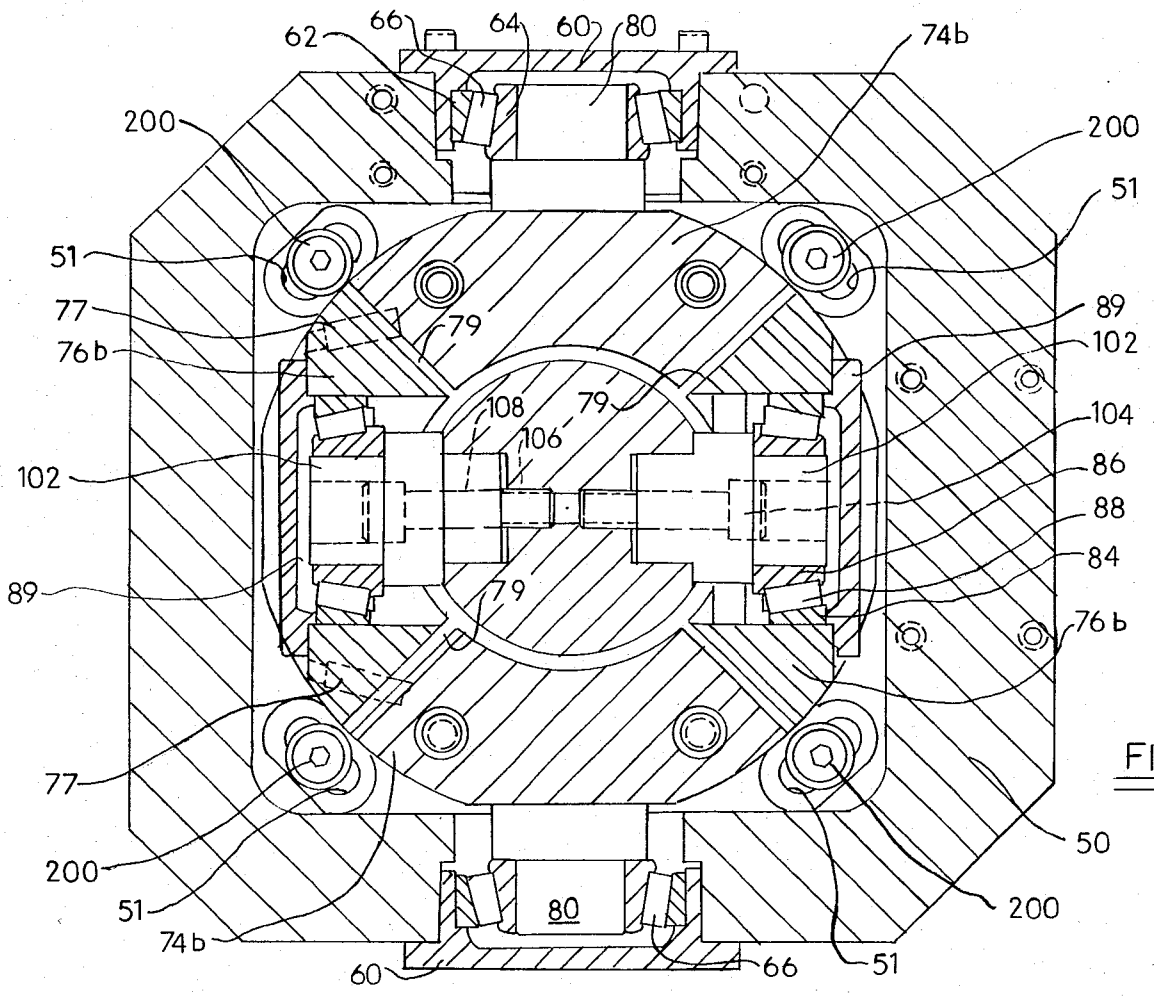
FIG. 5 is a sectional view of the dressing device taken along line 5—5 of FIG. 4.

As is apparent from FIGS. 1–5, upper head portion 74 includes a pair of trunnions 80 which are journaled in the inner bearing races 64 of the gimbal support member 50, FIG. 3, and are thus pivotable about an axis A1. The lower head portion 76 includes a pair of second trunnion seats 82 oriented substantially perpendicular to the first trunnion seats 54. Bearing assemblies similar to those described hereinabove are disposed in seats 82, i.e., the bearing assemblies include outer race 84, inner race 86 and tapered roller bearings 88 therebetween. A bearing retainer 89 is provided for retaining the outer race 84, as shown in FIG. 4.

The dresser post carrier member 70 also includes a partial tubular member 98 having a radial flange 94 which is fastened to the bottom of the lower head portion 76 by machine screws. The tubular portion 96 above the flange 94 extends inside the lower head portion 74 while the partial tubular portion 98 extends below the flange 74. The depending partial tubular portion 98 functions as a support for various adjustment components as will be explained more fully hereinbelow.

Another component of the gimbal mechanism is the dresser post member 100 which includes a pair of second trunnions 102 journaled in the inner races 86 disposed within second trunnion seats 82. As shown most clearly in FIGS. 4 and 5, the trunnions 102 comprise separate components fastened to the dresser post member by machine screws 104 threadably received in a threaded cross-bore 106 in the dresser post member as well as extending through a cross-bore 108 through the trunnions.

Figure 6:
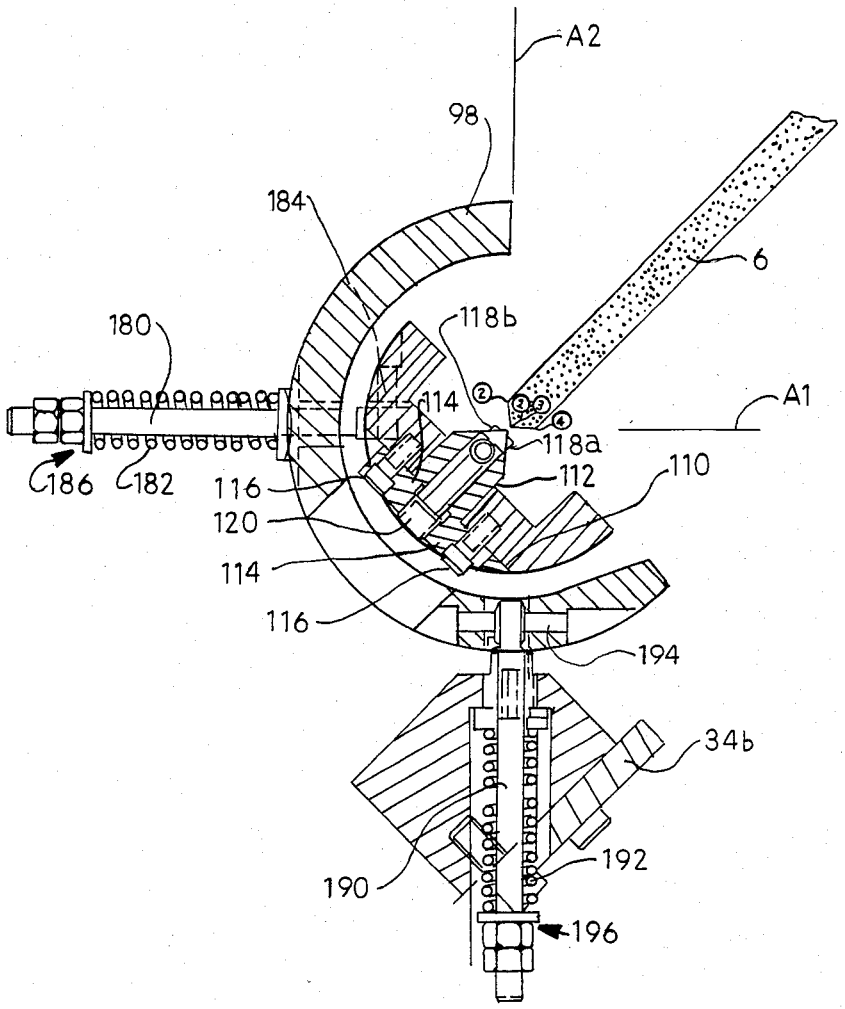
FIG. 6 is a sectional view of the dressing device taken along line 6—6 of FIG. 4.

Near the lower end of the dresser post member 100 there is a recess 110 and through-bore 112 communicating therewith. A diamond dresser cartridge 114 is disposed in the recess 110 and bore 112 as best seen in FIGS. 3, 4 and 6 and secured therein by machine screws 116. A diamond dresser having twin points 118*a*, 118*b* is carried and controlled by screw 120 threadably received in threaded bore 122 of the cartridge. An adjustment screw 124 is provided on cartridge 114 for purposes to be explained below.

The upper end of the dresser post member 100 is in the form of an upstanding cylinder 126 and adjacent flange 128 on which a cam mounting plate 130 is mounted by machine screws 132 and is movable with the dresser post member 100 when it pivots.

As shown somewhat schematically in FIG. 2 and in more detail in FIGS. 3 and 4, the cam mounting plate 130 supports cam driving means in the form of an electric motor 136, first pulley 138, belt 140 and second pulley 142. Second pulley 142 is rotatably mounted on end 126 of the dresser post member 100 by a pair of conventional ball bearing assemblies 144, 146 retained on the end 126 by threaded retainer cap 148. A rotatable cam 133 is fastened to the top of the second pulley 142 by machine screws 135 as shown best in FIGS. 3 and 7. There are multiple adjustable dogs 150 attached to the circumference of the second pulley 142 for actuating conventional limit switches 152 and 154 which control the electric motor 136, in particular, the direction of rotation of the motor and ultimately of the cam 133 through the belt and pulley arrangement described.

Figure 7:
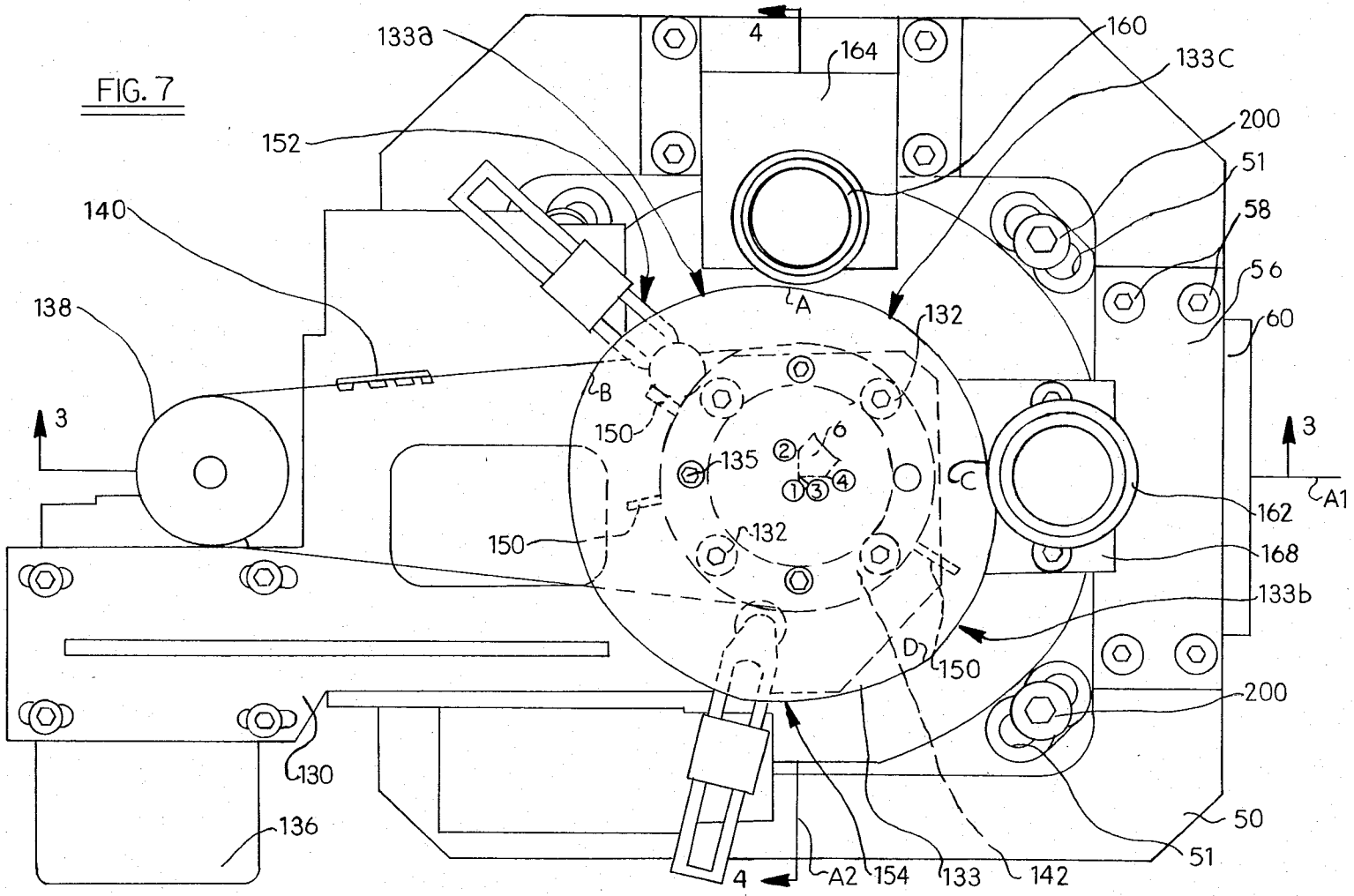
FIG. 7 is a top elevation of the dressing device of the invention.

As shown most clearly in FIG. 7 the cam 133 is adapted as by having spaced-apart lobed regions 133*a* and 133*b* to engage against first and second cam followers 160 and 162, respectively. Cam follower 160 is rotatably mounted on an inverted L-shaped bracket 164 which, in turn, is mounted on gimbal support member 50, e.g. FIG. 4. Cam follower 162 is mounted on another L-shaped bracket 168 which, in turn, is mounted on the upper head portion 74 of the carrier member 70; e.g. FIG. 3. This figure shows cam follower 162 secured on a stud 170 by means of a standard ball bearing assembly 172. Cam follower 160 is similarly mounted so that it is also freely rotatable.

It will be apparent that this arrangement of the cam mechanism and gimbal mechanism will operate as follows. Electric motor 136 is actuated to rotate cam 133 clockwise to position point A at cam follower 162, FIG. 7. During this rotation, the lobed region 133*a* of the cam traverses past and engages against cam follower 160 until point B is at cam follower 160 at which time rotation is stopped. Engagement of lobed region 133*a* with cam follower 160 causes the dresser post carrier member 70 and dresser post member 100 carried thereon to pivot about axis A1. This pivoting causes the dresser 118, in turn, to swing along a path from circled 1 to circled 2, FIGS. 6 and 7. The electric motor 136 is then run in the reverse direction to cause cam 133 to rotate counterclockwise to return point A to its former position adjacent cam follower 160. Rotation of the cam 133 is then continued to place point C at cam follower 160. During this rotation, the lobed region 133*b* of the cam traverses and engages cam follower 162 until point D is at cam follower 162 at which time rotation is stopped. Engagement of lobed region 133*b* causes the dresser post member 100 to be pivoted away from follower 162 about pivot axis A2. This causes the dresser 118 to swing along a path from circled 3 to circled 4, FIGS. 6 and 7. Reversal of the direction of cam rotation to the position shown in FIG. 7 returns the dresser 118 to the initial circled 1 or 3 position. Of course, the dogs 150 and limit switches 152 and 154 are used to control the sequence of motor operation and cam rotation.

Rotation of the cam 133 first clockwise and then counterclockwise causes the dresser post member 100 to pivot about two different axes perpendicular to one another and along paths which can be made to be coplanar with the perpendicular surfaces of the grinding wheel working face. The actual path followed by either diamond point is of course an arc of selected radius, e.g. an arc of 10 inch radius with a one inch travel across each surface of the grinding wheel working face in one working embodiment of the invention. The desired path of dresser 118 if the V-profile working face is to have zero convexity or concavity is a straight line which is coplanar with the perpendicular surface of the grinding wheel working face. In the embodiment shown in FIGS. 1–7, the straight line path is very closely approximated by providing adjustment screw 124 on the dresser cartridge 114 and by providing adjustable stops 170 and 172 on the frame extension 34*a* and on the partial tubular portion 98 of the carrier member 70, respectively. These stops 170 and 172 cooperate with stop plugs 174 and 176 on the partial tubular portion 98 of the carrier member and on the dresser post member 100, respectively. Each stop arrangement has an associated return mechanism in the case of stop 172 comprising a shaft 180 and return spring 182. It is apparent that shaft 180 has one end pivotally mounted on the dresser post member 100 by means of a rod 184. When the dresser post member 100 swings away from the carrier portion 98 about pivot axis A2, the spring 182 is compressed as the shaft 180 and nut/washer assembly 186 threaded thereon are pulled in the direction of swinging movement. When the dresser post member 100 is at the end of its swing (and the cam 133 is reversed in rotation), the return mechanism returns the dresser post member 100 to its initial position with stop plug 176 against stop 172. The other return mechanism operates in a similar manner when the dresser post carrier member 70 with dresser post member 100 is swung on the perpendicular path to the other and includes similar components, namely a shaft 190, return spring 192, nut-washer assembly 196 and a connecting rod 194 in the carrier portion 98.

The adjustment screw 124 is rotated such that during the swinging movement of dresser 118, the points 118*a*, 118*b* thereof are first below and then above the desired straight line path in equal amounts and the stops 170 and 172 are adjusted by threading in or out in their associated threaded bores to locate dresser post member 100 and dresser carrier assembly 70 in a vertical position. In this manner, the arc path of the dresser 118 is positioned so as to achieve a negligible deviation from the desired straight line path for dressing purposes.

Adjustment screws 77 described hereinabove are provided to permit the nominally 90° angle between axes A1 and A2 to be adjusted a limited amount to accommodate variations in grinding wheel working face profiles.

Threaded holes 40 already described in frame member 30, aligned slots 51 in gimbal support member 50 and companion adjustment screws 200 are provided to permit the 90° angle between axes A1 and A2 to be up to 6° off symmetrical in either direction with respect to the axis of revolution of the grinding wheel. This provides ample adjustment for initial set-up of the dresser. Also, the four bolts 200 may be threaded into four other tapped holes in frame member 30 which holes are not shown but are displaced 45° from those (40) shown to permit use of the inventive dressing device on occasions when a simple cylindrical wheel surface is to be dressed.

Operation of the inventive dressing device will be apparent to those skilled in the art from the above detailed description. Briefly, however, for dressing, the dressing device is located as shown best in FIGS. 6 and 7 with respect to the working face of the grinding wheel 6. The starting position of the dresser 118 is indicated at circled 1 (or circled 3). In this position, cam 133 is positioned as shown in FIG. 7 with respect to cam followers 160 and 162, i.e. point A is adjacent cam follower 160 and point C is adjacent cam follower 162. As described above, cam 133 is first rotated clockwise to position point A adjacent cam follower 162 instead of cam follower 160. Coaction of the lobed region 133*a* against the cam follower 160 causes the dresser post carrier member 70 and dresser post member 100 to pivot about axis A1 and move dresser 118*a* across the wheel working face from circled 1 to circled 2 position, thereby dressing that face. The rotation of cam 133 is then reversed to return it to the position shown in FIG. 7. During reversal, return spring 192 returns the dresser post carrier member 70 to the position where stop plug 174 abuts against stop 170. The cam 132 is then rotated further in the counterclockwise direction to position point C adjacent cam follower 160. Coaction of lobed region 133*b* of the cam against the cam follower 162 causes the dresser post member 100 to pivot about axis A2 and dresser 118*b* is swung along a path from circled 3 (or 1) to circled 4 across the associated wheel face to dress same. The cam rotation is again reversed to bring it back to the position of FIG. 7. During reversal, the return spring 182 returns the dresser post member 100 to the original position where stop plug 176 abuts against the stop 172. Of course, the grinding wheel 6 is rotated during the dressing operation.

The present inventive dressing device provides several advantages. In particular, the wheel surfaces that are dressed are characterized by improved straightness and smoothness since the dresser tool is not itself directly driven by a cam but indirectly through the gimbal mechanism having a smooth, true swinging motion. And, the gimbal and cam mechanisms are not subject to same wear problems as experienced heretofore by the direct cam driven technique used.

While the invention has been described by a detailed description of certain specific and preferred embodiments, it is understood that various modifications and changes can be made in any of them within the scope of the appended claims which are intended to also include equivalents of such embodiments.

We claim:

1. In a dressing device for dressing a grinding wheel having a working face comprised of intersecting substantially planar working surfaces defining a working face included angle therebetween, the combination of a gimbal means from which a dresser means is suspended and swung about two intersecting axes defining therebetween an included angle substantially equal to said working face included angle, said dresser means including a twin point dresser with the points oriented relative to the working surfaces such that swinging of the gimbal means about one axis causes one dresser point to swing in a plane to dress one working surface and about the other axis causes the other dresser point to swing in a plane to dress the other working surface, and cam means on the gimbal means for actuating said gimbal means to swing said dresser means successively about one of said axes and then the other so as to dress the working surfaces one at a time.

2. The dressing device of claim 1 wherein the gimbal means includes a gimbal support member having a pair of first trunnion seats, a carrier member having a pair of first trunnions pivotably seated in said first trunnion seats and having a pair of second trunnion seats oriented orthogonally relative to said first trunnion seats, and a dresser post member having a pair of second trunnions pivotably seated in said second trunnion seats and having said dresser means mounted thereon.

3. The dressing device of claim 2 wherein the cam means comprises a first cam follower mounted on the gimbal support member, a second cam follower mounted on the carrier member, and a cam and cam driving means mounted on the dresser post and movable therewith.

4. The dressing device of claim 3 wherein the cam has spaced-apart first and second lobed regions for successively engaging against the respective first and second cam followers when the cam is rotated in one direction and then the other and imparting a pivotable swinging movement to the dresser post member and dresser means thereon first about one orthogonal axis and then the other.

5. The dressing device of claim 4 wherein the cam driving means is an electric motor which rotates the cam by a belt means therebetween, said electric motor and cam being mounted on a support member affixed to the dresser post member.

6. The dressing device of claim 1 wherein the gimbal means includes adjustment means to control the pivotable swing of said dresser means such that there is negligible deviation in movement of the dresser means from a straight line path for purposes of dressing a grinding wheel.

7. The dressing device of claim 6 wherein the adjustment means comprises an adjustment screw for providing that said dresser means swings below and above the desired straight line path in substantially equally amounts.

8. A dressing device for a grinding machine for dressing a grinding wheel having a substantially 90° V-shape working face with intersecting working surfaces, comprising:

(a) a frame member supported on the grinding machine, (b) a gimbal mechanism supported on the frame member and comprising a gimbal support member mounted on the frame member and having a pair of first trunnion seats, a carrier member having a pair of first trunnions pivotably seated in said first trunnion seats and having a pair of second trunnion seats oriented substantially perpendicular to said first trunnion seats, and a dresser post member having a pair of second trunnions pivotably seated in said second trunnions seats and having dresser means mounted thereon, said dresser means including a twin point dresser with the points oriented relative to the working surfaces such that swinging of the gimbal mechanism about the first trunnions causes one dresser point to swing in a plane containing one working surface and about the second trunnions causes the other dresser point to swing in a plane containing the other working surface so as to dress the working surfaces and (c) a cam mechanism mounted on the gimbal mechanism to cause same to alternately swing the dresser post member and dresser means thereon about each axis defined by said first and second trunnion pairs, said cam mechanism including a first cam follower mounted on said gimbal support member, a second cam follower mounted on said carrier member, and a cam and cam driving means mounted on said dresser post member and movable therewith, said cam engaging said first and second cam followers in succession to cause the gimbal mechanism to pivotably swing said dresser means about one axis and then the other defined by said first and second trunnions so as to dress the working surfaces one at a time.

9. The dressing device of claim 8 which further includes adjustment means for controlling the pivotable swing of said dresser means in a substantial straight line path.

* * * * *